US006626322B1

(12) United States Patent
Carter et al.

(10) Patent No.: US 6,626,322 B1
(45) Date of Patent: Sep. 30, 2003

(54) RECEPTACLE FOR SPENT SMOKING MATERIALS

(75) Inventors: Glen Carter, Mattoon, IL (US); Frank Flider, Mattoon, IL (US)

(73) Assignee: Justrice Manufacturing Company, Des Plaines, IL (US)

( * ) Notice: Subject to any disclaimer, the term of this patent is extended or adjusted under 35 U.S.C. 154(b) by 0 days.

(21) Appl. No.: 09/855,058

(22) Filed: May 14, 2001

(51) Int. Cl.[7] ..... A24F 21/00
(52) U.S. Cl. ..... 220/576; 220/88.1
(58) Field of Search ..... 220/576, 88.1, 220/DIG. 13, 86.1, 573.1, 912, 213, 215, 913, 23.83, 23.86, 23.87, 571; 232/43.2

(56) References Cited

U.S. PATENT DOCUMENTS

| | | | | |
|---|---|---|---|---|
| 686,954 | A | | 11/1901 | Riley |
| D40,426 | S | | 1/1910 | Hochstadter |
| 1,013,775 | A | | 1/1912 | Hoffman |
| 1,080,837 | A | | 12/1913 | Leidel |
| 1,160,820 | A | | 11/1915 | Baur |
| 1,203,056 | A | | 10/1916 | Schilling |
| 1,239,427 | A | | 9/1917 | Bunnell et al. |
| D54,465 | S | | 2/1920 | Schulte et al. |
| 1,364,892 | A | | 1/1921 | Schulte et al. |
| 1,364,893 | A | | 1/1921 | Schulte et al. |
| 1,401,282 | A | | 12/1921 | Schroedter |
| D61,119 | S | | 6/1922 | Rosen |
| 1,459,096 | A | | 6/1923 | Gibbons |
| 1,472,804 | A | | 11/1923 | Mack |
| 1,504,310 | A | | 8/1924 | Backus |
| 1,511,217 | A | | 10/1924 | Floercky |
| D66,336 | S | | 12/1924 | Savery |
| 1,531,248 | A | | 3/1925 | Anderson |
| 1,547,578 | A | | 7/1925 | Frisone |
| 1,559,234 | A | * | 10/1925 | Fleming ..... 220/576 |
| D68,903 | S | | 12/1925 | Fleming |

(List continued on next page.)

FOREIGN PATENT DOCUMENTS

| | | | |
|---|---|---|---|
| DE | 2803820 | | 8/1979 |
| GB | 297982 | | 10/1928 |
| GB | 320843 | | 10/1929 |
| GB | 331530 | | 6/1930 |
| GB | 346418 | | 4/1931 |
| GB | 414224 | | 8/1934 |
| GB | 414786 | | 8/1934 |
| GB | 2124070 | | 2/1984 |
| GB | 2251545 | | 7/1992 |
| JP | 3-236767 | | 10/1991 |
| JP | 4-141075 | | 5/1992 |
| WO | WO97/25887 | * | 7/1997 |
| WO | WO00/5979 | | 2/2000 |

OTHER PUBLICATIONS

Justrite Manufacturing Co., catalog page of the Cease Fire® waste receptacle and other butt receptacles, Applicants aware of these receptacles prior to May 14, 2001.

(List continued on next page.)

*Primary Examiner*—Stephen Castellano
(74) *Attorney, Agent, or Firm*—Leydig, Voit & Mayer Ltd.

(57) ABSTRACT

A receptacle for spent smoking materials is provided. The receptacle includes a base portion defining a chamber for containing the smoking materials. The base portion has an open upper end having a rim. The receptacle also includes an upper portion having a neck which extends upward from a dome which engages the rim and encloses an upper end of the base portion. A seal being provided between the rim of the base and the dome. A head is arranged at the upper end of the neck. The head has an orifice therein for receiving spent smoking materials. The orifice being arranged underneath and adjacent a bonnet which protects the orifice from the infiltration of rainwater.

27 Claims, 6 Drawing Sheets

U.S. PATENT DOCUMENTS

| | | | | | |
|---|---|---|---|---|---|
| D69,098 | S | | 12/1925 | Smith | |
| 1,569,603 | A | | 1/1926 | Anderson | |
| D71,012 | S | | 9/1926 | Fleming | |
| 1,645,525 | A | * | 10/1927 | Fleming | 220/576 |
| 1,646,086 | A | | 10/1927 | Fleming | |
| 1,646,099 | A | | 10/1927 | Mitchell | |
| 1,653,897 | A | | 12/1927 | Farr | |
| 1,660,771 | A | | 2/1928 | Stevenson et al. | |
| 1,662,171 | A | * | 3/1928 | Savery | 131/242 |
| 1,670,525 | A | | 5/1928 | Savery | |
| 1,681,025 | A | | 8/1928 | Bradnack | |
| D76,417 | S | | 9/1928 | Putterman | |
| 1,684,589 | A | | 9/1928 | Kirts | |
| 1,695,346 | A | | 12/1928 | Reese | |
| 1,710,123 | A | | 4/1929 | Toops | |
| D78,726 | S | | 6/1929 | Baylis | |
| 1,719,925 | A | | 7/1929 | Cruess | |
| RE17,500 | E | | 11/1929 | Stevenson et al. | |
| 1,735,671 | A | | 11/1929 | Bunker | |
| 1,738,566 | A | | 12/1929 | Fleming | |
| 1,747,356 | A | | 2/1930 | Fleming | |
| 1,765,773 | A | | 6/1930 | Reichart | |
| 1,767,476 | A | | 6/1930 | Putterman | |
| D82,800 | S | | 8/1930 | Dalton | |
| D82,959 | S | | 12/1930 | Schwarz | |
| D83,836 | S | | 3/1931 | Shulman | |
| 1,802,938 | A | | 4/1931 | Burger | |
| 1,807,079 | A | | 5/1931 | Wilmanns | |
| D84,882 | S | | 8/1931 | Dalton | |
| 1,828,068 | A | | 10/1931 | Fringle | |
| 1,831,410 | A | | 11/1931 | Dalton | |
| 1,840,024 | A | | 1/1932 | Dalton | |
| 1,907,788 | A | | 5/1933 | Goertz et al. | |
| 1,908,279 | A | | 5/1933 | Baylis | |
| 1,921,933 | A | | 8/1933 | Levenberg et al. | |
| 1,937,084 | A | | 11/1933 | Janssen | |
| 2,059,105 | A | | 10/1936 | Heisenfeldt | |
| 2,087,360 | A | | 7/1937 | Shekerjian | |
| 2,093,517 | A | | 9/1937 | Gibson | |
| 2,110,773 | A | | 3/1938 | Nelson | |
| 2,114,027 | A | * | 4/1938 | McDonald | 131/241 |
| 2,114,527 | A | | 4/1938 | Fox | |
| 2,152,285 | A | | 3/1939 | Schirmer | |
| 2,228,008 | A | | 1/1941 | Groff | |
| 2,268,149 | A | | 12/1941 | Hinkle | |
| 2,291,753 | A | | 8/1942 | Patten | |
| 2,343,750 | A | | 3/1944 | Conran | |
| 2,390,657 | A | | 12/1945 | Loudermilk | |
| D143,742 | S | | 2/1946 | Mankki | |
| 2,437,226 | A | | 3/1948 | Fischer | |
| 2,440,783 | A | | 5/1948 | Peart | |
| 2,481,378 | A | | 9/1949 | Wolfset | |
| 2,567,166 | A | | 9/1951 | Dick | |
| 2,595,103 | A | | 4/1952 | Schmaling, Sr. | |
| 2,612,896 | A | | 10/1952 | Fox | |
| 2,716,414 | A | | 8/1955 | Nelson | |
| 2,718,432 | A | | 9/1955 | Hudachek | |
| 2,779,341 | A | | 1/1957 | Smillie | |
| 2,786,595 | A | | 4/1957 | Nelson | |
| 2,842,280 | A | | 7/1958 | Nelson | |
| 3,082,901 | A | | 3/1963 | Nakagawa | |
| D200,837 | S | | 4/1965 | Menold | |
| D201,942 | S | | 8/1965 | Feldman | |
| D203,423 | S | | 1/1966 | Kingsley | |
| 3,522,812 | A | | 8/1970 | Chism et al. | |
| 3,709,427 | A | | 1/1973 | McGregor | |
| 3,848,769 | A | | 11/1974 | Beil | |
| 3,853,263 | A | | 12/1974 | Otsuka | |
| 3,964,630 | A | | 6/1976 | Getz | |
| D248,329 | S | | 6/1978 | Gensini | |
| 4,133,319 | A | | 1/1979 | Bloomfield | |
| 4,142,537 | A | | 3/1979 | Fenelon | |
| D306,259 | S | | 2/1990 | Daucourt | |
| 5,123,562 | A | | 6/1992 | Bullard et al. | |
| 5,205,299 | A | | 4/1993 | Chen | |
| D347,924 | S | | 6/1994 | Yurk | |
| 5,377,907 | A | * | 1/1995 | Guard | 209/702 |
| 5,601,095 | A | | 2/1997 | Bright | |
| D389,600 | S | | 1/1998 | Luedecke | |
| D397,496 | S | | 8/1998 | Luedecke | |
| 5,826,589 | A | | 10/1998 | Ohanian | |
| 5,924,425 | A | | 7/1999 | Luedecke | |
| D414,581 | S | | 9/1999 | Yurk | |
| 5,947,322 | A | | 9/1999 | Ho | |
| D414,889 | S | | 10/1999 | Luedecke | |
| D428,192 | S | | 7/2000 | Meyer | |
| 6,116,246 | A | | 9/2000 | Glenn et al. | |
| D431,674 | S | | 10/2000 | Brady | |
| 6,135,305 | A | | 10/2000 | Brady | |
| 6,161,549 | A | | 12/2000 | Lee | |
| 6,186,355 | B1 | * | 2/2001 | Luedecke | 220/576 |
| D441,493 | S | | 5/2001 | Weiss et al. | |
| 6,227,400 | B1 | | 5/2001 | Paladino | |
| D450,899 | S | | 11/2001 | Caron | |
| D452,929 | S | | 1/2002 | Perelli | |
| D455,519 | S | | 4/2002 | Luedecke et al. | |

OTHER PUBLICATIONS

CSL, Inc. Environmental Products, brochure featuring the Smokers' Outpost and the Smokers' Sidekick including different versions of the Outpost, Applicants aware of these prior to May 14, 2001.

Protectoseal, catalog page featuring a cigarette/cigar butt can.

Eagle Mfg. Co., brochure featuring the Butt Can with "New Tube Design", Applicants first became aware of this can after the filing date of the instant patent application.

Lab Safety Supply Catalog, catalog page featuring the Eagle® Butt Can and other cigarette containers, 1998.

Ex–Cell Metal Products Co., Inc., catalog featuring various smoking stands, 1980–1981.

Ex–Cell Metal Products, Inc., USA, brochure featuring the Smokers' Oasis™, Applicants became aware of this reference after the filing date of the instant patent application.

Form '87, p. 86, Group 2900 Library–Ashtray Publication Box, Dec. 3, 1979.

Butt Stop, web pages featuring various receptacles, printed May 16, 2000, from http://www. Buttstop.com/ buttstop.html.

Signore, Inc., web pages featuring the ButtStop™ outdoor cigarette disposal unit, printed on Dec. 13, 2001, from http://www.Signore.com/buttstop.html, copyright 2000.

Upbeat Inc., Clean City Trash Canalog, catalog pages featuring the Ash Stash receptacle and other receptacles, Apr. 2001.

The No Butts Bin Company, web pages featuring various cigarette receptacles, printed in 2002, from http://www.nobutts.com.

Upbeat Inc., web pages featuring various receptacles and urns, printed on Jan. 21, 2002, from http://www.upbeatinc-.com, copyright 2000.

Johnsons Environmental Products, web pages featuring various cigarette receptacles, printed on Jan. 15, 2002, from http://www.buttstop.com., copyright 2001.

CSL Inc. Environmental Products, instructional flyer for the Smoker's Outpost series waste receptacle, Applicants became aware of this flyer prior to May 14, 2001.

* cited by examiner

RECEPTACLE FOR SPENT SMOKING MATERIALS

FIELD OF THE INVENTION

The invention generally relates to receptacles for spent smoking materials. More specifically, the invention relates to a repository that accepts spent smoking materials and extinguishes any smoldering smoking debris.

BACKGROUND OF THE INVENTION

Smoking necessarily produces unsightly litter in the form of cigarette or cigar butts and spent matches. This litter can be difficult to clean up effectively because of its germ-carrying potential and small size. Also, smoldering smoking refuse poses an obvious fire hazard, particularly when disposed of in ordinary trash cans containing other flammable refuse.

With the proliferation of environmental and workplace regulations that force smokers outdoors, a high concentration of smoking related litter can accumulate in areas where smokers congregate or pass by. Receptacles are generally placed in these areas to encourage smokers to discard their spent smoking materials in the receptacles rather than on the ground. Frequently, these receptacles include ordinary trash cans in combination with an ashtray for receiving the smoking related litter. These designs have several significant drawbacks. For example, the ashtray portion of the receptacle can quickly become filled with cigarette butts and the like. Because the debris in the ashtray is visible, the appearance of the receptacle becomes quite unappealing. Moreover, if the smoker does not adequately extinguish the cigarette before discarding it in the receptacle, the cigarette can continue to burn or smolder producing smoke and creating a fire hazard particularly with respect to the trash can portion of the receptacle.

To address these concerns, various self-extinguishing receptacle designs have been marketed. One example of such a receptacle is disclosed in U.S. Pat. No. 6,186,355 ("the '355 patent"). The '355 patent discloses a receptacle consisting of a lower base portion that defines a cavity for receiving the smoking materials and an upper portion which defines an elongated tapered inner throat passage which communicates with the cavity in the base. Portals are provided in the upper portion near the upper end of the tapered internal passage for depositing the smoking related debris into the receptacle.

These designs have several shortcomings. The smoldering smoking refuse produces smoke that includes among other chemicals, tar and nicotine. The chemicals collect and build up on the inner surface of the enclosure. Then, the chemicals begin to drip and run down the enclosure producing a dark-colored runoff that can escape at the joint between the upper and lower portions and run down the exterior surfaces of the receptacle. This problem can be compounded by rainwater that enters the receptacle through the unprotected smoking debris portals located in the upper portion. The tar-and-nicotine-infused water then freely runs down the exterior of the base portion. This effect is typically unacceptable, particularly at the entrances to corporate offices and public spaces such as museums, restaurants, shops, and the like.

The tapered throat passage with its contiguous portals also fails to provide a means for partially extinguishing the smoking articles before insertion into the receptacle. As a result, there is unnecessary smoking and smoldering within the receptacle. This leads to increased dark-colored runoff and also increases the likelihood that there would be smoke escaping from the portals as the materials smolder in the receptacle. If sufficient oxygen is permitted to enter the receptacle as by an improperly placed upper section, there is also a heightened fire hazard.

These designs also have the shortcoming that they fail to control the air circulation in the lower cavity. The designs provide for two tapered sections, one in the lid portion and one in the inner throat portion. Together, the sections provide for a tapering configuration from the lower collection area to the portals. This tapering configuration assists the air in flowing from the smoldering debris to the outside, which has the effect of heightening the likelihood that smoke will escape possibly falsely indicating that the receptacle is on fire inside. Such an effect is disruptive to the businesses where the receptacle is placed.

These designs also suffer from the shortcoming that water and rain can enter the portals because they are not covered. While the side placement of the portals provides some protection from the entry of rain and the like, if rain is falling at an angle, it can freely flow into the device.

Visibility and attractiveness to smokers is another important feature of any receptacle for smoking refuse. In the '355 patent design, the slim, tapered design of the upper end of upper portion, where the refuse portals are located, can be easily overlooked by smokers. The purpose of these inconspicuous portals may not be immediately apparent to smokers, particularly against certain backgrounds. As a result, smoking refuse may end up littering an area near such a receptacle, because the receptacle did not attract smokers' notice.

SUMMARY OF THE INVENTION

Accordingly, the present invention provides a receptacle with features that are significantly different and better than other receptacles. The receptacle includes a non-tapered neck portion with an enlarged head containing openings for receiving smoking debris. The enlarged head provides an angled inner surface and a bonnet arrangement which shields the openings from taking in rain and the like. The angled inner surface head provides a large surface for the smokers to partially extinguish their smoking materials before inserting them into the receptacle.

The configuration of the illustrated embodiment of the present invention also controls the gaseous circulation within the receptacle by generating eddy airflows. In addition to the non-tapered head and neck portions, the lower dome-shaped cap of the upper portion is not tapered, but is convex in form relative to the base portion. Thus, as the smoke rises, it flows along the convex surface and collides into smoke flowing on the other side. As the streams collide they begin to back around, thus producing an eddy effect. This helps reduce the possibility of smoke escaping out of the openings in the neck. The gaseous circulation is also controlled by a restrictive configuration at the base of the neck. Instead of tapering from an open interface as in other designs. The neck portion becomes narrower before the interface with the dome portion. This narrowed passage assists in separating the gaseous contents of the lower portion of the device openings.

Furthermore, the illustrated embodiment of the present invention includes a uration for preventing the runoff of dark chemicals to the outside of the device.

These and other advantages of the present invention, as well as additional features, will be apparent from the description of the invention provided herein.

DETAILED DESCRIPTION OF THE INVENTION

Figure 1:
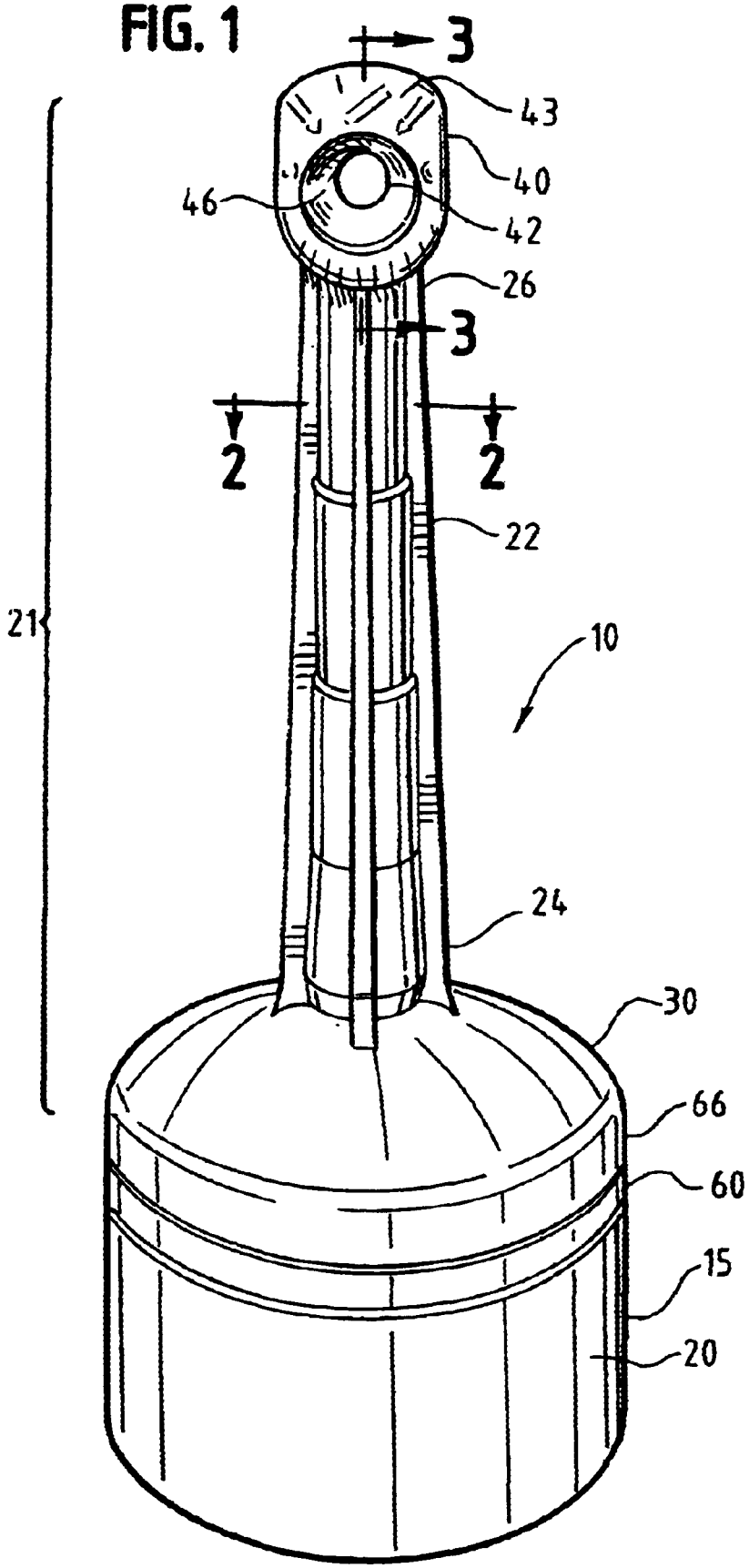
FIG. 1 is a perspective view of an exemplary receptacle for spent smoking constructed in accordance with the invention.

Turning now to the drawings, FIG. 1 provides a perspective view of an exemplary embodiment of the invention, a receptacle 10 for spent smoking materials. The receptacle 10 generally consists of a base portion 15 defining a chamber 20 for containing spent smoking materials, and an upper portion 21 including a neck 22 having lower and upper ends 24, 26. At either end of the neck, the upper portion includes a head 40 and a dome 30. The dome 30 encloses an open upper end of the base portion 15 such that the head 40 is in communication with the chamber 20 via the neck 22. As will be described in greater detail below, spent smoking materials that are deposited into the head 40 fall through the neck 22, into the chamber 20 for containment. In the chamber 20, the unsightly spent smoking materials are hidden from view, dramatically improving the appearance of the receptacle as compared to conventional ashtrays. Moreover, the receptacle is configured so as to restrict the flow of oxygen into the chamber so that the smoking materials are safely and quickly extinguished thereby reducing the risk of fire.

Figure 2:
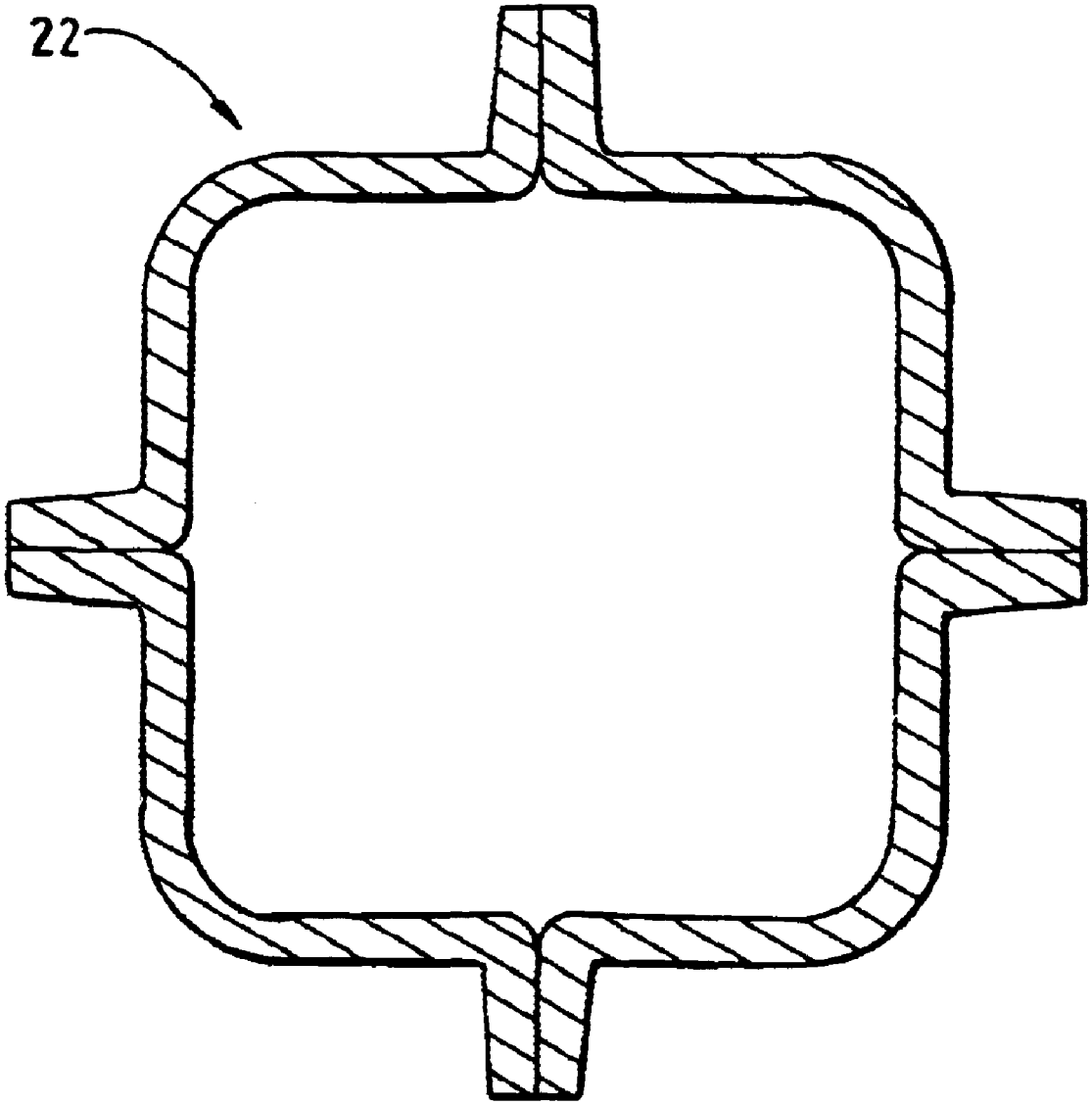
FIG. 2 is a sectional view of the neck portion of the receptacle of FIG. 1, ong line 2—2 of FIG. 1.
Figure 3:
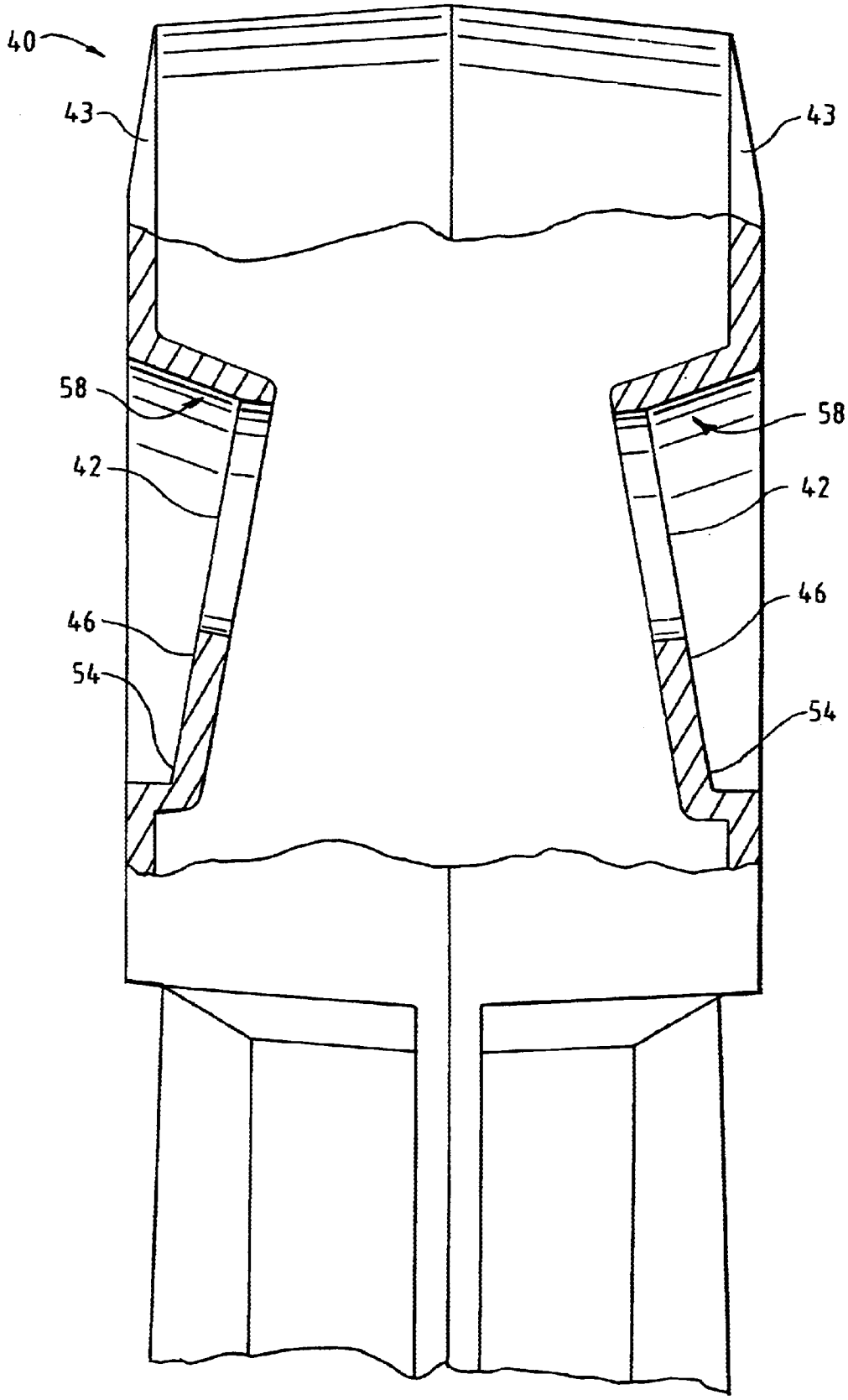
FIG. 3 is a sectional view of the head portion of the receptacle of FIG. 1, ong line 3—3 of FIG. 1.

For receiving smoking related refuse, the head 40 has one or more orifices 42 formed therein. These orifices 42 communicate with the interior of the head 40, and in turn with the chamber 20, via the neck 22. Thus, as illustrated by FIG. 1, smoking materials inserted into one of the orifices 42 will fall into the chamber 20 through the neck 22. As best shown in FIGS. 2 and 3, the head 40 has a larger horizontal cross-sectional area than the neck 22. As a result of its enlarged configuration, the head 40 can better attract the attention of smokers to the orifices 42 through which they should deposit their spent smoking materials, thus inviting their use. The inclusion of a written inscription or label 43 on the head 40 itself can make the orifices even more conspicuous to smokers. Of course, it will be appreciated that the inscription or label can be in any suitable form including, for example, a self-adhesive label.

To provide protection against the infiltration of rainwater, the orifices 42 can be disposed on panels 46 that are recessed into the head portion 40 so as to define a respective bonnet 58 over each of the orifices 42. In this instance, each panel 46 is oriented with its upper bonnet edge recessed more deeply into the head 40 than its lower edge 54. These bonnets 58 shield the orifices 42 from even most wind-blown rainwater. The shielding effect of the bonnets 58 is enhanced by shifting each orifice 42 upwards from the center of its respective panel 46 closer to the bonnet as shown in FIG. 3. Thus, the bonnet 58 is enlarged while still maintaining the orifice 42 in an easily accessible location.

The recessed panels 46 also provide a surface for extinguishing the smoking debris before disposal. In particular, the portions of the panels below the orifices can define extinguishing surfaces for smokers to crush or stub out their cigarette or cigar butts. The angled orientation of the panels makes the extinguishing surfaces easily accessible and allows the smokers to use a natural downward stubbing motion. Moreover, the extinguishing surfaces are conveniently located proximate the orifices so as to encourage their use by smokers.

Figure 7:
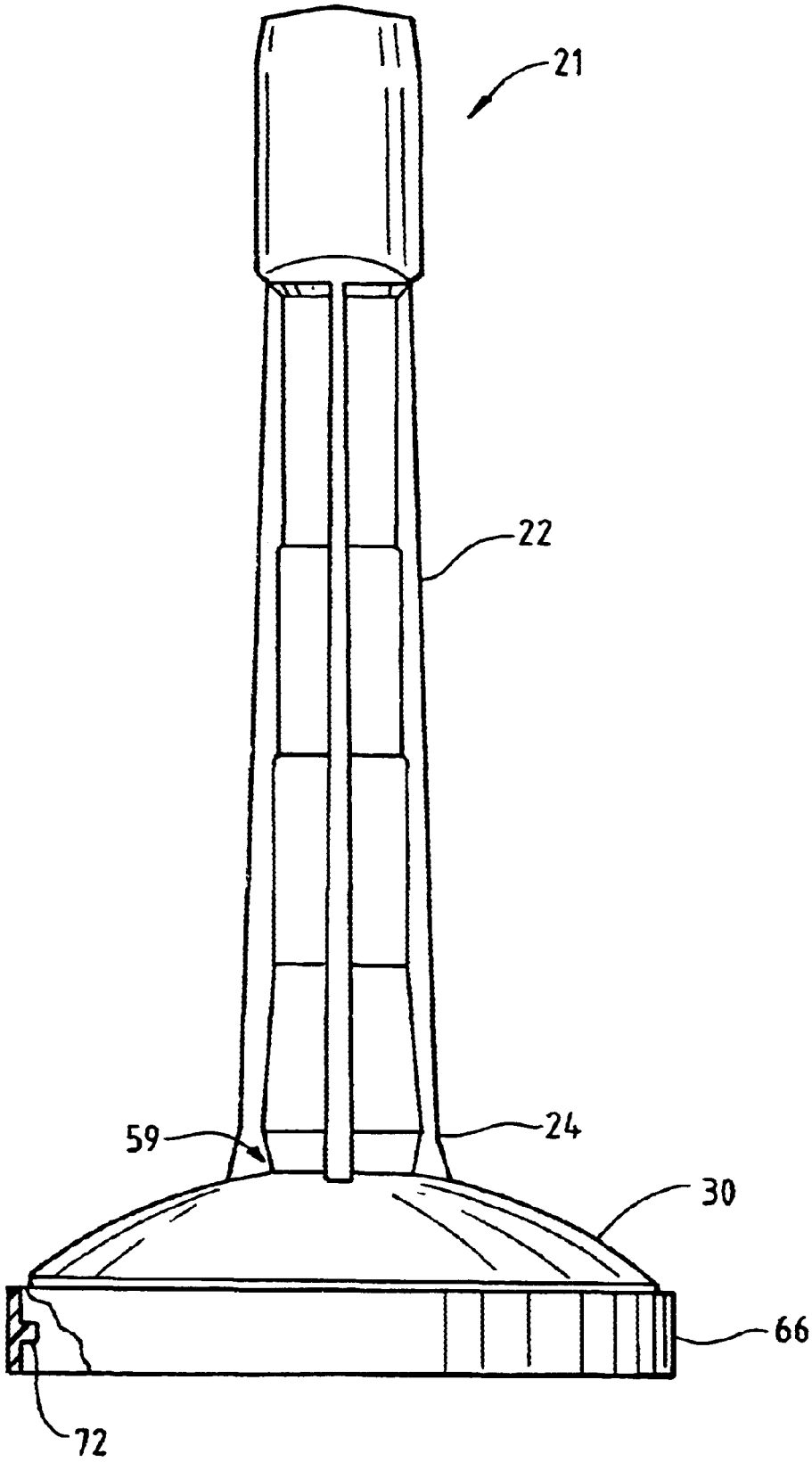
FIG. 7 is a side elevational view, partially cut away, of the upper portion of eptacle of FIG. 1, further illustrating the locking tab portion.

As noted above, the configuration of the receptacle 10 limits the flow of combustion-supporting oxygen into the chamber. The resulting oxygen deprivation tends to smother and choke off any smoldering materials deposited into the chamber 20. Extinguishing of the cigarettes is enhanced by the configuration of the dome 30 which covers the base portion 15. As shown in FIGS. 1 and 7, the dome 30 arches downwardly from the lower end 24 of neck 22 and covers the chamber 20. The convex shape of the dome 30 will naturally cause the smoke within the chamber 20 to circulate in eddy currents that naturally limit the flow of smoke upwards through the neck 22. In addition to limiting the escape of smoke through the orifices 42 in the neck 22, these eddy currents help limit the oxygen available to support combustion in the chamber 20.

Figure 8:
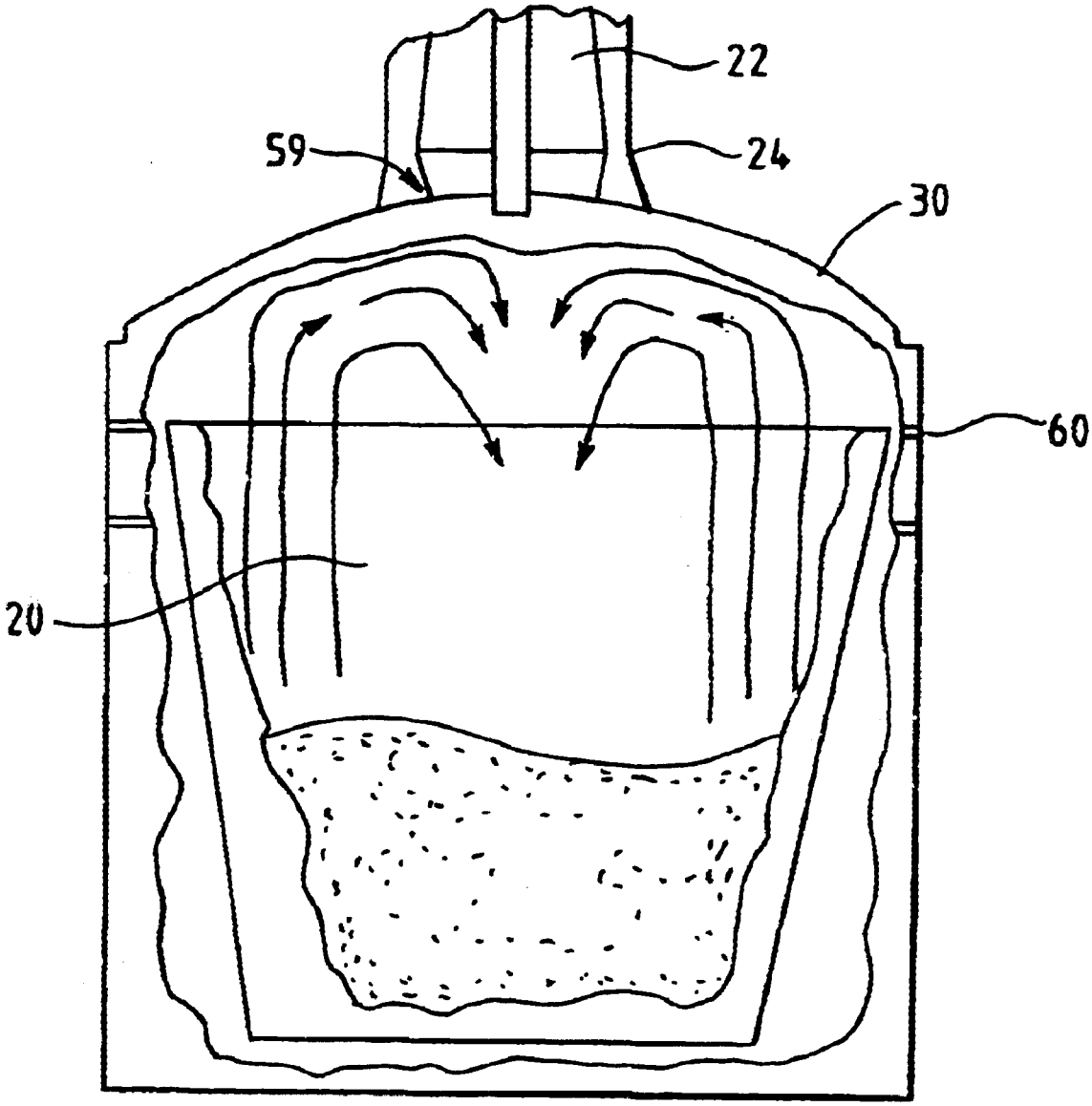
FIG. 8 is a partial side sectional view of the receptacle of FIG. 1 showing the circulation of smoke in eddy currents in the chamber.

Specifically, smoke from any smoldering materials in the chamber 20 will naturally drift upward toward the underside of the dome 30 as shown in FIG. 8. When the smoke reaches the dome, it is directed inward towards the lower end 24 of the neck 22. As the smoke approaches the lower end 24 of the neck 22, the curve of the dome, which at this point is nearly perpendicular relative to the longitudinal axis of the neck, drives the smoke in an almost horizontal direction. Thus, when the smoke converges on the neck it all mixes together and is driven back in the downward direction away from the opening to the neck 22. This helps prevent smoke from drifting up through the neck 22 and out the orifices 44. This effect is further enhanced by a necked-in portion 59 provided at the transition between the dome 30 and the neck 22 which limits the size of the opening through which smoke can escape the chamber 20. The circulation of smoke in eddy currents possibly could also help reduce the build-up of tar and nicotine on the underside of the dome 30.

Figure 4:
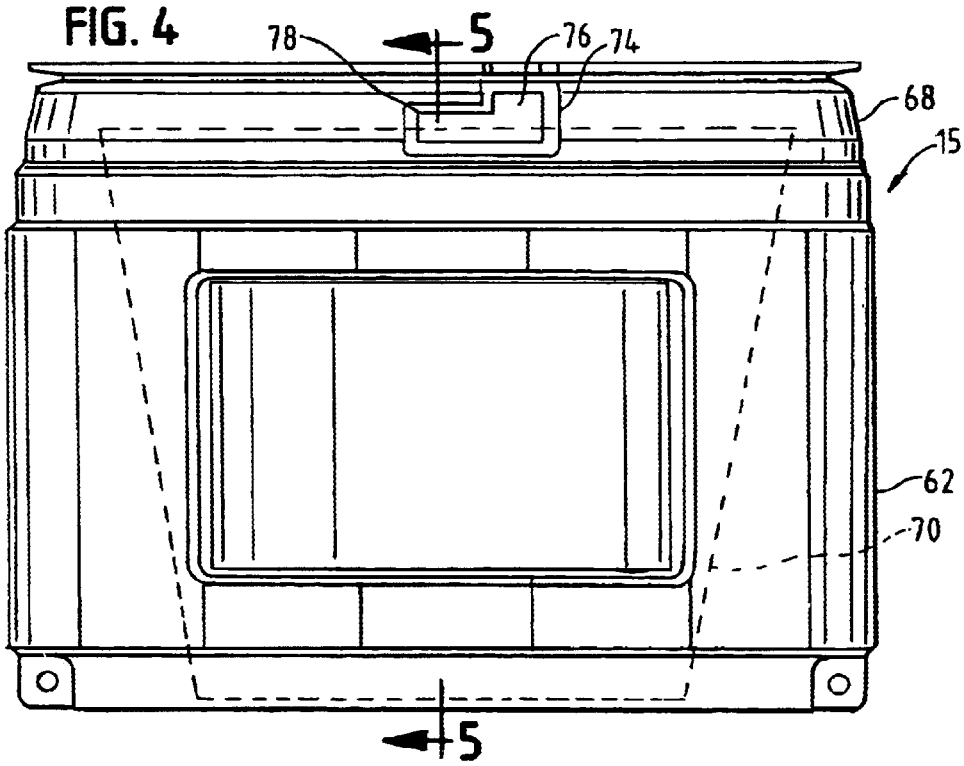
FIG. 4 is a side elevational view of the base portion of the receptacle of FIG. 1.
Figure 5:
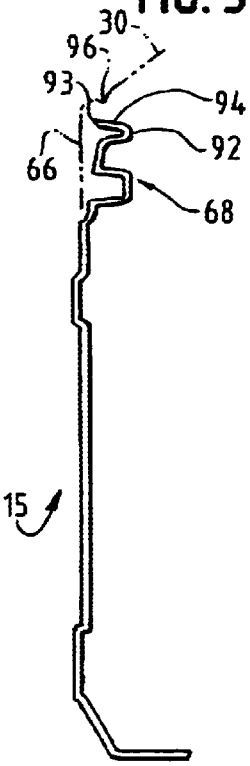
FIG. 5 is a sectional view of the base portion of the receptacle of FIG. 4, long line 5—5 of FIG. 4.
Figure 6:
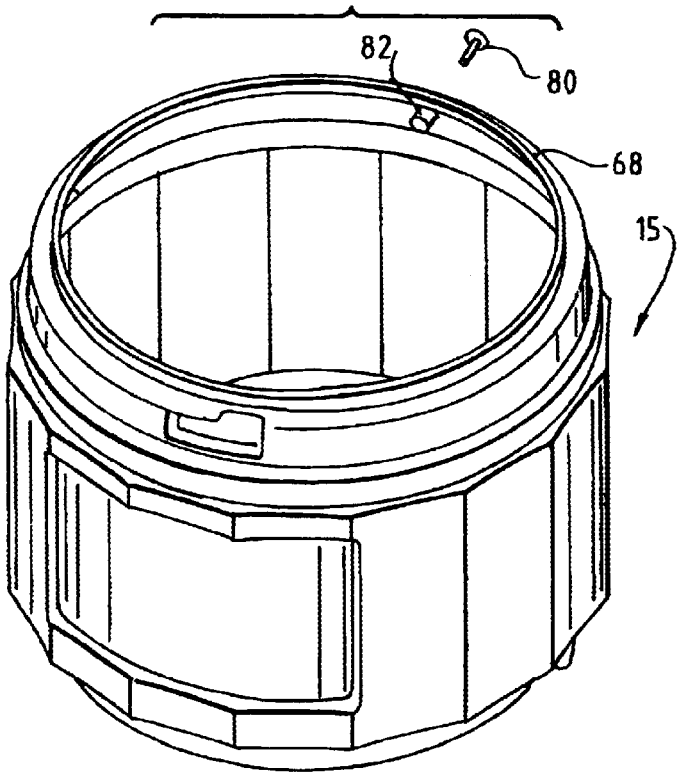
FIG. 6 is a perspective view of the base portion of the receptacle of FIG. 1, illustrating the locking channel.

To facilitate removal of the smoking materials contained in the chamber, the upper portion 21 is joined to the base portion 15 by a separable connection 60. In the illustrated embodiment, as shown in FIGS. 4 and 6, the base portion 15 consists of a bottom wall 62 and a continuous sidewall 64 extending upwardly in perpendicular relation therefrom. Accordingly, the bottom wall 62 is, in this case, as at least as large as the open upper end of the base portion 15. This imparts stability to the receptacle 10 by providing a broad base and a relatively low center of gravity. As shown in FIGS. 1, 5 and 7, the separable connection 60 between the dome 30 and the base portion 15 is facilitated by an edge skirt 66 that extends downwardly from the dome 30, and overlaps the upper rim 68 of the sidewall 64.

Removal of the spent smoking materials can be eased by the use of a bucket 70 in the chamber 20. This eliminates the need to lift the base portion 15, which may be tied down to prevent theft or toppling caused by high winds. It will be appreciated that the receptacle 10 and bucket 70 can be constructed of any appropriate fire retardant material, e.g., galvanized steel or polyethylene with a flame-retardant additive.

A secure connection is provided between the dome 30 and the base portion 15, by a locking mechanism. As shown in FIGS. 4 and 7, in the illustrated embodiment, the locking mechanism is a tab-and-groove type system. In particular, a tab 72 extends radially inward from the inner surface of the dome edge skirt 66 toward the interior of the chamber 20. A complementary slide-lock groove 74 is provided along the upper rim 68 of the base portion 15. The groove 74 has a vertical leg 76 that receives the tab 72 as the dome edge skirt 66 engages the base portion 15. When the dome 30 contacts the upper rim 68 of the base portion 15, the dome is then rotated relative to the base portion such that the tab 72 slides along a horizontal leg 78 of the groove74, thus locking the dome to the base portion. The effectiveness of the locking mechanism can be enhanced by a threaded knob 80, as seen in FIG. 6. The knob 80 passes through a complementary hole in the edge skirt 66, and engages a threaded receiver 82 disposed in the rim 68 of the base portion 15. The threaded receiver 82 is arranged approximately diametrically opposite the slide lock components.

Another beneficial feature of the invention is the prevention of dark trails along the exterior of the sidwall of the base portion 15. The present embodiment of the invention includes flow diverting structure incorporated between the upper rim 68 of the base portion 15 and the dome edge skirt 66. In this case, the flow diverting structure includes a lip 92 on the upper rim 68 of the base portion 15 as shown in FIG. 5. The lip 92 can be a molded extension of rim 68, and extends from an edge 93 radially inward toward the interior of the base portion 15 so as to define a flow directing surface 94. The interior of the dome 30, on the other hand, includes a drip edge 96, in this case in the form of a bead, which extends the dome 30, inside of the edge skirt 66. When the upper portion 21 is attached to the base portion 15 to enclose the chamber 20, the drip edge 96 is arranged over and in relatively close proximity to the flow directing surface 94 of the lip 92. The tar-and-nicotine-infused water which is directed along the underside of the dome 30 is blocked by the drip edge 96 and directed downwards onto the flow directing surface 94 of the lip. The flow directing surface 94, in turn, directs the water back into the interior of the chamber 20. Thus, the flow diverting structure prevents the water from escaping the receptacle through the joint 60. As will be appreciated , any suitable flow diverting arrangement can be used between the upper portion and the base portion including the use of separate components such as a sealing ring or any other type of sealing structure.

From the foregoing, it can be seen that the receptacle of the present invention not only serves to keep the surrounding environment clean, but provides an attractive and aesthetically appealing appearance for the receptacle itself by hiding from view the unsightly spent smoking materials. The openings into the receptacle can be shielded from rainwater and are highly visible and obvious to smokers. The receptacle reduces fire risk by smothering any smoldering smoking materials that are deposited therein. Further, a seal between the upper and lower portions of the receptacle prevents any dark colored run-off from the receptacle.

While this invention has been described with an emphasis upon exemplary embodiments, variations of the exemplary embodiments can be used, and it is intended that the invention can be practiced otherwise than as specifically described herein. Accordingly, this invention includes all modifications encompassed within the spirit and scope of the invention as defined by the claims.

What is claimed is:

1. A receptacle for spent smoking materials which prevents tar and nicotine infused run-off from leaking out of the receptacle, the receptacle comprising:

a base portion having an upper rim surrounding an open end of the base portion, an upper portion arranged on the upper rim of the base portion and which is separable therefrom along a joint, the upper portion including a dome having a convex configuration relative to the base portion which encloses the open end of the base portion so as to define a chamber for containing spent smoking materials, a head and a neck, the neck having an elongated inner passage extending therethrough for providing communication between the chamber and an orifice in the head for receiving the spent smoking materials, the head having a relatively larger cross-sectional area than the internal passage, and a flow diverting mechanism disposed in the chamber, the flow diverting mechanism including a drip edge arranged on an interior surface of the dome for blocking fluid flow along the interior surface of the dome before the fluid reaches the joint and causing the blocked fluid to drip downward off the interior surface of the dome the drip edge extending alone the length of and in close proximity to the joint, and a flow directing surface arranged beneath and in close proximity to the drip edge the flow directing surface being arranged above and in close proximity to the joint and with at least a portion of the flow directing surface being in vertical alignment with the drip edge, the flow directing surface being sloped so as to direct fluid dripping off the drip edge towards the interior of the chamber.

2. The receptacle according to claim 1 wherein the head includes a bonnet which is arranged directly above the orifice.

3. The receptacle according to claim 2 wherein the orifice is arranged in a panel recessed from an outer surface of the bonnet.

4. The receptacle according to claim 3 wherein the recessed panel is recessed deeper at an upper edge adjacent the bonnet than at a lower edge.

5. The receptacle according to claim 1 wherein the head includes a surface for stubbing out smoking materials arranged underneath the orifice.

6. The receptacle according to claim 5 wherein the orifice is arranged in a panel recessed into the head and the portion of the recessed panel beneath the hole defines the stubbing surface.

7. The receptacle according to claim 6 wherein a ledge formed by the recessed panel defines a lower edge of the stubbing surface.

8. The receptacle according to claim 1 further including a locking mechanism which secures the upper portion to base portion at the joint.

9. The receptacle according to claim 1 further including a bucket arranged in the chamber of the base portion.

10. A receptacle for spent smoking materials comprising a base portion having an upper rim surrounding an open end of the base portion, an upper portion arranged on the upper rim of the base portion and enclosing the open end thereof so as to define a chamber for spent smoking materials, the upper portion having an elongated inner passage for providing communication between the chamber and an orifice for receiving the spent smoking materials, the upper portion being separable from the base portion along a joint, and a flow diverting mechanism disposed in the chamber, the flow diverting mechanism including a drip edge arranged on an interior surface of the upper portion for blocking fluid flow along the interior surface of the upper portion before the fluid reaches the joint and causing the blocked fluid to drip downward off the interior surface of the upper portion, the drip edge extending along the length of and in close proximity to the joint, and a flow directing surface arranged beneath and in close proximity to the drip edge the flow directing surface being arranged above and in close proximity to the joint and with at least a portion of the flow directing surface being in vertical alignment with the drip edge, the flow directing surface being sloped so as to direct fluid dripping off the drip edge towards the interior of the chamber.

11. The receptacle according to claim 10 wherein the flow direction surface is arranged on the upper edge of the base portion.

12. The receptacle according to claim 10 wherein the upper portion includes a head at an upper end of the internal passage and the orifice is disposed in the head.

13. The receptacle according to claim 12 wherein the head has a larger cross-sectional area than the internal passage.

14. The receptacle according to claim 12 wherein the head includes a bonnet which is arranged directly above the orifice.

15. The receptacle according to claim 12 wherein the head includes a surface for stubbing out smoking materials.

16. The receptacle according to claim 10 wherein the upper portion includes a dome that has a convex configuration relative to the base portion and encloses the open end of the base portion.

17. The receptacle according to claim 10 further including a locking mechanism which secures the upper portion to base portion at the joint.

18. The receptacle according to claim 10 further including a bucket arranged in the chamber of the base portion.

19. A receptacle for spent smoking materials which prevents tar and nicotine infused run-off from leaking out of the receptacle, the receptacle comprising:

a base portion having an upper rim surrounding an open end of the base portion, an upper portion arranged on the upper rim of the base portion and which is separable therefrom along a joint, the upper portion including a cover portion which encloses the open end of the base portion and a neck so as to define a chamber for receiving spent smoking materials, the neck having an elongated inner passage extending therethrough for providing communication between the chamber and an orifice for receiving the spent smoking materials, and a flow diverting mechanism disposed in the chamber, the flow diverting mechanism including a drip edge arranged on an interior surface of the cover portion for blocking fluid flow along the interior surface of the cover portion before the fluid reaches the joint, the drip edge extending along the length of and in close proximity to the joint and causing the blocked fluid to drip downward off the interior surface of the cover portion and a flow directing surface arranged beneath and in close proximity to the drip edge the flow directing surface being arranged above and in close proximity to the joint and with at least a portion of the flow directing surface being in vertical alignment with the drip edge the flow directing surface being sloped so as to direct fluid dripping off the drip edge towards the interior of the chamber.

20. The receptacle according to claim 19 wherein the flow directing surface is arranged on the upper rim of the base portion.

21. The receptacle according to claim 19 wherein the upper portion includes a head at an upper end of the internal passage and the orifice is disposed in the head.

22. The receptacle according to claim 21 wherein the head has a larger cross-sectional area than the internal passage.

23. The receptacle according to claim 19 wherein the upper portion includes a head having a bonnet which is arranged directly above the orifice.

24. The receptacle according to claim 19 wherein the upper portion includes a head having a surface for stubbing out smoking materials.

25. The receptacle according to claim 19 wherein the cover portion of the upper portion has a convex configuration relative to the base portion.

26. The receptacle according to claim 19 further including a locking mechanism which secures the upper portion to base portion at the joint.

27. The receptacle according to claim 19 further including a bucket arranged in the chamber of the base portion.

* * * * *